US009604267B2

(12) United States Patent
Mori et al.

(10) Patent No.: US 9,604,267 B2
(45) Date of Patent: Mar. 28, 2017

(54) METHOD FOR PRODUCING MAGNESIUM ALLOY SHEET AND MAGNESIUM ALLOY COIL STOCK

(75) Inventors: Nobuyuki Mori, Itami (JP); Yukihiro Oishi, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 1061 days.

(21) Appl. No.: 13/511,898

(22) PCT Filed: Nov. 15, 2010

(86) PCT No.: PCT/JP2010/070315
§ 371 (c)(1),
(2), (4) Date: May 24, 2012

(87) PCT Pub. No.: WO2011/065248
PCT Pub. Date: Jun. 3, 2011

(65) Prior Publication Data

US 2012/0244373 A1 Sep. 27, 2012

(30) Foreign Application Priority Data

Nov. 24, 2009 (JP) ..... 2009-266068
Nov. 4, 2010 (JP) ..... 2010-247159

(51) Int. Cl.
*B21B 3/00* (2006.01)
*C22C 23/00* (2006.01)
(Continued)

(52) U.S. Cl.
CPC ..... *B21B 3/00* (2013.01); *B21B 38/006* (2013.01); *B21B 2003/001* (2013.01); *B21B 2267/12* (2013.01); *Y10T 428/12333* (2015.01)

(58) Field of Classification Search
CPC ..... B21B 2003/001; B21B 2267/12; B21B 38/006; B21B 3/00; Y10T 428/12333; C22C 23/00; C22C 23/02
(Continued)

(56) References Cited

U.S. PATENT DOCUMENTS 2,957,349 A 10/1960 Holowaty et al.
4,346,014 A * 8/1982 Piucci ..... C10M 173/00 508/275
(Continued)

FOREIGN PATENT DOCUMENTS

CN 1758969 A 4/2006
CN 101010152 A 8/2007
(Continued)

OTHER PUBLICATIONS

Korean Decision to Grant for corresponding Korean Application No. 10-2012-7012481, dated Sep. 26, 2014, 2 pages.
(Continued)

*Primary Examiner* — Jessee Roe
*Assistant Examiner* — Anthony Liang
(74) *Attorney, Agent, or Firm* — Ditthavong & Steiner, P.C.

(57) ABSTRACT

There are provided a method for producing a magnesium alloy sheet having good press formability and a magnesium alloy coil stock obtained by coiling the magnesium alloy sheet. After a raw material sheet 1 composed of a magnesium alloy is preheated to 280° C. or less, the heated raw material sheet 1 is rolled with a reduction roll 3 and the obtained long rolled sheet is coiled. The surface temperature of the reduction roll 3 is set to be 230° C. or more and 290° C. or less. The preheating, rolling, and coiling are repeatedly performed in a continuous manner. By setting both the temperatures of the raw material sheet 1 and reduction roll
(Continued)

3 to be certain temperatures, the rolling property of the raw material sheet can be improved and the raw material sheet can be properly rolled in a continuous manner. In addition, a variation in temperature in the width direction of the reduction roll can be suppressed and uniform rolling can be performed, resulting in the production of a long magnesium alloy sheet. In this magnesium alloy sheet, working strain is sufficiently introduced by rolling and an increase in the size of crystal grains is suppressed. Thus, the magnesium alloy sheet has good press formability. Furthermore, a coil stock in which telescoping is not easily caused and that has good appearance is obtained.

7 Claims, 1 Drawing Sheet

(51) Int. Cl.
*C22C 23/02* (2006.01)
*B21B 38/00* (2006.01)

(58) Field of Classification Search
USPC ..... 148/667
See application file for complete search history.

(56) References Cited

U.S. PATENT DOCUMENTS 5,078,807 A * 1/1992 Chang et al. ..... C22F 1/06 148/406
5,672,401 A * 9/1997 Anglin ..... B65D 25/14 106/270
5,698,031 A 12/1997 Winkle
2005/0067068 A1* 3/2005 Shimizu ..... B21B 3/00 148/667
2011/0067474 A1* 3/2011 Tazoe et al. ..... B21B 1/34 72/200

FOREIGN PATENT DOCUMENTS

CN 101422784 A 5/2009
EP 1829623 A1 9/2007
EP 2213387 A1 8/2010
JP 2007/044751 A 2/2007
JP 2007044751 * 2/2007 ..... B21B 1/22
JP 2007/098470 A 4/2007
JP 3988888 B2 7/2007
JP 2008-163398 A 7/2008
JP 2008163398 A * 7/2008 ..... B21B 1/22
JP 2009-095848 A 5/2009
JP 2009-125751 A 6/2009
KR 10-1995-0016975 A 7/1995
KR 10-2004-0076944 A 9/2004
KR 10-2006-0072798 A 6/2006
TW 200927314 A * 7/2009 ..... B21B 1/34
WO 2009051176 A1 4/2009

OTHER PUBLICATIONS

Extended European Search Report for corresponding European Application No. 10 833 095.2, dated Oct. 10, 2014, 4 pages.
Office Action for corresponding Chinese Application No. 201080053144.3, issued Nov. 25, 2013.
International Search Report for PCT Application No. PCT/JP2010/070315 dated Dec. 28, 2010, pp. 1-2.
Extended European Search Report for corresponding European Patent Application No. 10833095.2, dated May 24, 2013, 9 pages.

* cited by examiner (A)
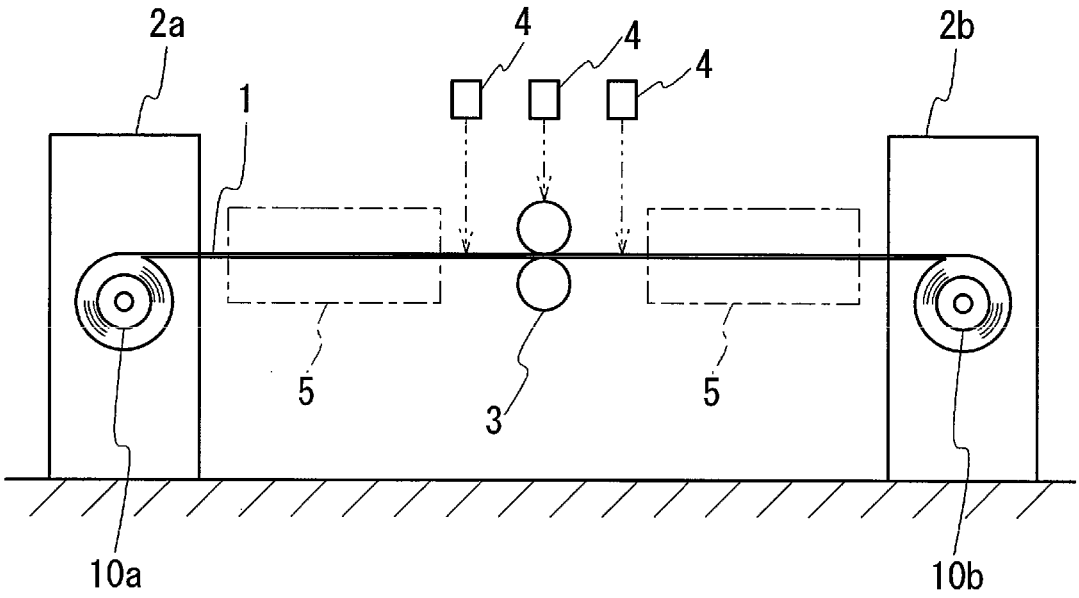
(B)
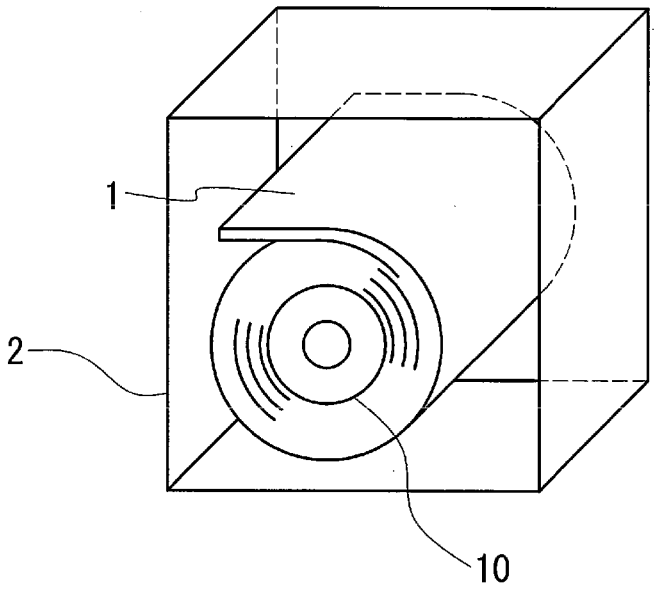

METHOD FOR PRODUCING MAGNESIUM ALLOY SHEET AND MAGNESIUM ALLOY COIL STOCK

TECHNICAL FIELD

The present invention relates to a method for producing a magnesium alloy sheet, the method providing a long magnesium alloy sheet, and a magnesium alloy coil stock obtained by coiling the sheet. In particular, the present invention relates to a method for producing a magnesium alloy sheet, the method providing a long magnesium alloy sheet having good press formability.

BACKGROUND ART

Magnesium alloys containing magnesium and various elements are lightweight and have a high strength-to-mass ratio and good shock absorbency. Therefore, magnesium alloys have been examined as constituent materials for housings of electric and electronic devices such as cellular phones and mobile computers and constituent materials for various members such as parts of automobiles. Since magnesium alloys have a hexagonal crystalline structure (hexagonal close-packed (hcp) structure), they have poor plastic formability at ordinary temperature. Therefore, magnesium alloy products used for the housings and the like are mainly formed of cast materials by a die casting process or a thixomolding process. However, when a thin sheet, in particular, the above-described member is mass-produced, it is difficult to produce a long sheet suitable for a raw material of such a thin sheet or member by the casting process above.

AZ31 alloy of the American Society for Testing and Materials (ASTM) standard is relatively easily subjected to plastic forming. Therefore, it has been examined that the thickness of a cast sheet composed of the AZ31 alloy is decreased by subjecting the cast sheet to plastic forming such as rolling or press forming. For example, Patent Literature 1 discloses that a thin magnesium alloy sheet is produced by subjecting a raw material composed of AZ31 alloy to warm rolling and then subjecting the raw material to shear deformation with a roller leveler and a recrystallization heat treatment in a combined manner.

Since AZ91 alloy of the ASTM standard has high corrosion resistance and strength, it is expected to be increasingly demanded as a wrought material. However, AZ91 alloy contains Al in a larger amount than AZ31 alloy and thus is inferior to AZ31 alloy in terms of plastic formability. Patent Literature 2 proposes that, when a magnesium alloy raw material sheet composed of AZ91 alloy and obtained by twin-roll casting or the like is subjected to rolling, the temperature of the raw material sheet and the temperature of a reduction roll be controlled in a certain range (relatively low temperature). As a result of the temperature control, an increase in the size of crystal grains is suppressed, cracks are not easily formed in the surface of the raw material, and rolling is properly performed.

CITATION LIST

Patent Literature

Patent Literature 1: JP3988888B

Patent Literature 2: JP2007-098470A

SUMMARY OF INVENTION

Technical Problem

Since magnesium alloy structural members subjected to plastic forming such as press forming, deep drawing, or bending have better mechanical properties than cast materials, an increase in the productivity of such members subjected to plastic forming is demanded. For example, to improve the productivity, a long raw material is prepared and the raw material is continuously supplied to a plastic forming machine such as a pressing machine. In addition, such a raw material desirably has good plastic formability such as good press formability. However, a method for producing a sheet (typically rolled sheet) suitable for a long raw material having good plastic formability, in particular, a raw material of members subjected to plastic forming such as members subjected to press forming has not been sufficiently examined. In particular, a development of a long sheet having good plastic formability and composed of a magnesium alloy such as AZ91 alloy that contains a large amount of additive elements and has good characteristics such as high strength, corrosion resistance, and impact resistance has been demanded.

The inventors of the present invention have examined that, in the production of a long rolled sheet, a long material, typically a coil stock obtained by coiling the long material, is used as a raw material of the long rolled sheet; the coil stock is preheated before inserting the coil stock into reduction rolls; the heated coil stock is uncoiled and rolled; and the rolled sheet is temporarily coiled. In other words, the inventors have examined that preheating, rolling, and coiling are repeatedly performed in a continuous manner to perform rolling with multiple passes. Specifically, they have examined the following. A pair of reduction rolls facing each other are disposed between a pair of reels that can be reversibly operated. A coil stock is set in one of the reels and an uncoiled raw material sheet is coiled with the other of the reels, whereby the raw material sheet is caused to travel between the reels. During the travel, the raw material sheet is rolled with the reduction rolls above. The rolling is repeatedly performed by reversing the reels, that is, by performing reverse rolling.

Since magnesium alloys containing a large amount of additive elements such as Al generally have poor plastic formability, the plastic formability of the magnesium alloys is preferably increased by heating when plastic forming such as rolling is performed. For example, Patent Literature 2 discloses that, during rough rolling, the temperature of a raw material sheet is about 350° C. and the surface temperature of reduction rolls is about 200° C.; and, during finish rolling, the temperature of a raw material sheet is about 210° C. and the surface temperature of reduction rolls is about 150° C. However, when significantly different heating temperatures of a raw material sheet are employed in a rolling step, a coil stock coiled after rolling is removed from the reels, the temperature of reduction rolls is adjusted, and again the coil stock needs to be set in the reels. As the number of passes increases, the number of steps of setting and removing the coil stock increases. This makes it difficult to perform continuous rolling, which results in a decrease in the productivity of rolled sheets and furthermore a decrease in the productivity of members subjected to plastic forming.

For the purpose of continuously performing rolling and producing a long rolled sheet with high productivity, the temperature of the raw material sheet is increased to improve the plastic formability of the raw material sheet.

Specifically, the raw material sheet may be heated to about 350° C. throughout all passes. However, in this case, as the number of passes increases, the raw material sheet is annealed during rolling. Consequently, the size of crystal grains of the magnesium alloy constituting the raw material sheet is increased, or working strain (shear zone) accumulated in the raw material with the reduction rolls is released to decrease the amount of strain. Thus, the obtained rolled sheet tends to have poor press formability.

Alternatively, for example, the temperature of reduction rolls may be increased to improve the plastic formability of a raw material sheet. However, if the temperature of reduction rolls is excessively increased, a variation in temperature in the width direction (axial direction) of the reduction rolls easily increases. Since reduction rolls are often composed of a metal material, if the reduction rolls have a variation in temperature, the degree of expansion is different depending on positions of the reduction rolls and thus the reduction rolls locally deform. More specifically, for example, in the case where a heater is disposed in the central portion in the width direction of each of the reduction rolls to heat the reduction roll, the reduction roll may have a shape in which the central portion expands (crown shape). In particular, when a wide reduction roll is used to produce a wide material, such a variation in temperature is easily caused because the temperature of both edges of the reduction roll is generally more easily decreased than that of the central portion. If rolling is performed while the reduction roll is deformed as described above, the central portion in the width direction of a magnesium alloy sheet obtained after the rolling becomes thin and the edge portions become thick. Such a variation in thickness in the width direction decreases not only the value of products but also the flatness. Furthermore, if a rolled sheet having a variation in thickness in the width direction is coiled after the rolling, the effect of the variation in thickness increases as the number of turns increases, and it becomes difficult to coil the rolled sheet while edge portions are aligned. Even if the rolled sheet is coiled, the edge portions of the obtained coil stock are not aligned and the surfaces of turns has projections and depressions, that is, a coil stock having significant telescoping is obtained. Furthermore, since the edge portions of the raw material sheet are relatively easily cooled compared with the central portion, cracking is easily caused and thus a coil stock having significant edge cracking is obtained. Such a coil stock having significant telescoping and a coil stock having significant edge cracking have a low value as a product, like the above-described coil stock having a variation in thickness and coil stock having poor flatness. These coil stocks decrease the yield and thus decrease the productivity.

Accordingly, an object of the present invention is to provide a method for producing a magnesium alloy sheet in which a long magnesium alloy sheet having good press formability can be produced with high productivity. Another object of the present invention is to provide a magnesium alloy coil stock having small telescoping.

Solution to Problem

As a result of various examinations, the inventors of the present invention have found the following. That is, it is not effective to heat either of a raw material sheet or a reduction roll to high temperature for the purpose of performing continuous rolling. To achieve the purpose, preferably, the temperatures of both the raw material sheet and reduction roll are set in a certain range, and the operation temperature of the reduction roll is set in a relatively narrow range. The present invention is based on the findings above.

A method for producing a magnesium alloy sheet of the present invention is a method in which a raw material sheet composed of a magnesium alloy is rolled and the obtained long rolled sheet is coiled to produce a coiled magnesium alloy sheet, the method including a preheating step, a rolling step, and a coiling step below that are repeatedly performed in a continuous manner multiple times.

Preheating step is a step of heating the raw material sheet and the heating temperature of the raw material sheet is 280° C. or less.

Rolling step is a step of rolling the heated raw material sheet with a reduction roll and the surface temperature of the reduction roll is 230° C. or more and 290° C. or less.

Coiling step is a step of coiling the rolled sheet.

By the production method of the present invention above, for example, a magnesium alloy coil stock of the present invention below is produced. The magnesium alloy coil stock of the present invention is produced by coiling a long sheet composed of a magnesium alloy, and the telescoping is within 5 mm.

According to the production method of the present invention, by heating both the raw material sheet and reduction roll to a certain temperature, the plastic formability (mainly, rolling property) of the raw material sheet is improved and thus rolling can be properly performed in a continuous manner. In particular, by relatively increasing the heating temperature of the raw material sheet in a temperature range in which an increase in the size of crystal grains and the release of working strain can be suppressed, the operation temperature is set in a relatively narrow range of 230° C. or more and 290° C. or less without excessively increasing the temperature of the reduction roll. That is, the setting temperature of the reduction roll is selected from a relatively narrow range of 230 to 290° C. By specifying the setting temperature of the reduction roll in the range above, even if rolling is continuously performed, the reduction roll is not easily excessively heated and local thermal expansion of the reduction roll and local deformation caused by the thermal expansion can be suppressed. As a result, in the reduction roll, a uniform shape can be maintained in the width direction and thus continuous rolling can be uniformly performed in the width direction of the raw material sheet. Therefore, according to the production method of the present invention, a long magnesium alloy sheet is produced. The produced magnesium alloy sheet has good press formability because the size of crystal grains is small and working strain is sufficiently accumulated.

Furthermore, when a variation in the shape in the width direction of the reduction roll is suppressed as described above, the produced magnesium alloy sheet has a small variation in thickness in the width direction of the magnesium alloy sheet and preferably has a uniform thickness over the entire length and width and furthermore has good flatness. When the thickness is uniform, the magnesium alloy sheet can be coiled with high precision even if the magnesium alloy sheet is a long sheet. Therefore, the coil stock of the present invention in a coiled state has, for example, small telescoping as described above and thus has a high value as a product. By suppressing the variation in the shape in the width direction of the reduction roll as described above, the production method of the present invention can provide a magnesium alloy sheet having small edge cracking. That is, the coil stock of the present invention in a coiled state has, for example, small edge cracking and thus has a high value as a product. Herein, for example, when aluminum or an alloy thereof or iron or an alloy thereof is subjected to rolling, the degree of rolling in the width direction of a raw material is not easily varied even if a difference in temperature in the width direction of the reduction roll is large. As a result, the thickness of the produced rolled sheet is also not easily varied. In contrast, the workability of magnesium alloys is significantly affected by temperature. In the production method of the present invention, the operation temperature of the reduction roll is set in a relatively narrow range as described above and the temperature of the raw material sheet is set in a certain range. Thus, rolling can be uniformly performed in the width direction of the raw material sheet. Consequently, a magnesium alloy sheet having a uniform metal microstructure, a uniform thickness, good flatness, small telescoping, and small edge cracking can be continuously produced as described above.

The above-described coil stock of the present invention that has a uniform thickness and good flatness and is coiled while the edge portions are aligned can contribute to the mass production of members subjected to plastic forming because members subjected to plastic forming can be continuously produced by setting the coil stock in a plastic forming machine such as a pressing machine to uncoil the coil stock. Since the magnesium alloy sheet constituting the coil stock of the present invention can be disposed at the predetermined position of the machine with high precision, members subjected to plastic forming can be produced with high dimensional accuracy by using the coil stock of the present invention.

In one embodiment of the present invention, the magnesium alloy contains aluminum in an amount of 7.0% or more by mass and 12.0% or less by mass.

In magnesium alloys containing aluminum as an additive element, as the content of aluminum increases, the corrosion resistance and strength are increased and thus a magnesium alloy sheet, a coil stock, and a member subjected to plastic forming each having high corrosion resistance and strength are produced. Specifically, AZ series alloys, AM series alloys, and Mg—Al-RE (rare-earth element) series alloys of the ASTM standard are exemplified. In particular, Mg—Al series alloys containing Al in an amount of 7.0 to 12.0% by mass and Zn in an amount of 0.5 to 3.0% by mass, such as AZ91 alloy, have high corrosion resistance and good mechanical properties such as high strength and plastic deformation resistance compared with other Mg—Al series alloys such as AZ31 alloy. However, as the content of aluminum increases, magnesium alloys are hardened. Consequently, defects such as cracks are easily caused during working such as rolling and the plastic formability tends to degrade. Therefore, the temperature (at least one of temperatures of a raw material sheet and a reduction roll) during rolling is preferably controlled (typically increased) in a certain range in accordance with the type and content of additive elements.

In one embodiment of the production method of the present invention, a variation in the surface temperature (difference between the maximum temperature and the minimum temperature) of the reduction roll in a width direction of the reduction roll is 10° C. or less.

According to the embodiment above, the variation in temperature in the width direction of the reduction roll is significantly small, and rolling can be more uniformly performed in the width direction of the raw material sheet. Therefore, a magnesium alloy sheet having a small variation in thickness and small edge cracking and a coil stock having small telescoping can be properly produced. Preferably, in a region in the width direction of the reduction roll, the temperature of the reduction roll is controlled uniformly over the entire region the raw material sheet contacts. Specifically, the setting temperature of the reduction roll is selected from the above-described range, and the temperature of the reduction roll is controlled so as to fall within ±5° C. of the selected temperature.

In one embodiment of the production method of the present invention, in all passes including a final pass of the rolling, the temperature of the raw material sheet just before rolling is 150° C. or more and 280° C. or less.

In the case where rolling is continuously performed as in the production method of the present invention, the temperature of the raw material sheet is increased to some extent due to heat by working. Therefore, if the setting temperature of the raw material sheet is kept constant in the preheating step and rolling step, the temperature of the raw material sheet may exceed 280° C. as the number of passes increases. In contrast, in the embodiment above, the temperature of the raw material sheet is controlled so that the temperature of the raw material sheet just before rolling falls within the certain range above. Such temperature controlling effectively suppresses excessive heating of the raw material sheet. Consequently, a magnesium alloy sheet having a uniform thickness and a coil stock having small telescoping can be produced with high productivity. By controlling the temperature of the raw material sheet within the range above, the difference in temperature between the raw material sheet and the reduction roll is also made small. As a result, a magnesium alloy sheet and a coil stock each having good press formability can be produced with high productivity.

In one embodiment of the production method of the present invention, a difference between the temperature of the raw material sheet just before rolling and the surface temperature of the reduction roll is 30° C. or less.

The inventors of the present invention have found that, when the difference in temperature between the raw material sheet and the reduction roll is made small while the raw material sheet and reduction roll are heated to a certain temperature as described above, a long rolled sheet having a length of 1000 m or more is produced. Therefore, the embodiment above can contribute to the mass production of a magnesium alloy sheet having good press formability. As the difference in temperature decreases, a longer sheet is produced and thus the lower limit is not particularly specified.

In one embodiment of the production method of the present invention, the raw material sheet is a cast sheet produced by subjecting a molten magnesium alloy to continuous casting by a twin-roll casting process.

By a continuous casting process such as a twin-roll casting process, a long magnesium alloy cast sheet can be easily produced. According to the embodiment above, since a long sheet can be used as a raw material sheet to be subjected to a first pass of rolling, a raw material sheet (rolled sheet) used after a second pass is also a long sheet. Therefore, a longer rolled sheet can be produced with high productivity. In addition, since a cast sheet having good rolling property can be produced by the twin-roll casting process as described below, a longer rolled sheet can be produced with high productivity.

In one embodiment of the coil stock of the present invention, the thickness of the sheet is 0.8 mm or less and the length of edge cracking is within 8 mm.

As described above, in the production method of the present invention, a significantly thin magnesium alloy sheet having a desired thickness of, for example, 1.0 mm or less and furthermore 0.8 mm or less is produced by performing rolling with multiple passes. When such a thin sheet is used for materials of members subjected to press forming, a lightweight thin member subjected to press forming is produced. According to the production method of the present invention, as described above, cracking is not easily caused in the edge portions in the width direction of the rolled sheet, and the length of the cracking can be suppressed to at most about 8 mm. Therefore, according to the embodiment above, the amount of cracking removed after rolling can be decreased and the yield is increased. In this regard, the productivity of a coil stock and a member subjected to plastic forming such as a member subjected to press forming can also be improved.

Advantageous Effects of Invention

In the method for producing a magnesium alloy sheet of the present invention, a long magnesium alloy sheet having good press formability can be produced with high productivity. The magnesium alloy coil stock of the present invention has small telescoping.

BRIEF DESCRIPTION OF DRAWING

FIG. 1(A) is a diagram schematically showing an example of a rolling line used when a method for producing a magnesium alloy sheet of the present invention is performed. FIG. 1(B) is a diagram of a heat box used in a preheating step.

DESCRIPTION OF EMBODIMENTS

The present invention will now be described in detail with reference to the attached drawing.

[Production Method]

(Composition)

A production method of the present invention is expected to be applied to a magnesium-based alloy (the balance other than additive elements: Mg and incidental impurities) containing Mg as a base material (Mg: 50% or more by mass) and various additive elements. A coil stock of the present invention produced by the production method of the present invention can also be composed of one of magnesium alloys having various compositions. Examples of the additive elements include aluminum (Al), zinc (Zn), manganese (Mn), yttrium (Y), zirconium (Zr), copper (Cu), silver (Ag), silicon (Si), calcium (Ca), beryllium (Be), nickel (Ni), gold (Au), strontium (Sr), cerium (Ce), tin (Sn), lithium (Li), and RE (rare-earth elements, expect for Y and Ce). Examples of the magnesium-based alloy include AZ series alloys (Mg—Al—Zn series alloys, Zn: 0.2 to 1.5% by mass), AM series alloys (Mg—Al—Mn series alloys, Mn: 0.15 to 0.5% by mass), and Mg—Al-RE (rare-earth element) series alloys of the ASTM standard. Even if an alloy contains Al in a large amount of 7.0 to 12.0% by mass, by applying the production method of the present invention, rolling can be properly performed in a continuous manner as described above. As a result, the coil stock of the present invention that has small telescoping and is composed of a magnesium alloy sheet having a small variation in thickness and good mechanical properties can be produced. In addition, a magnesium alloy containing at least one element selected from Y, Ce, Ca, and rare-earth elements (expect for Y and Ce) in a total content of 0.001% or more by mass and preferably 0.1% or more by mass and 5% or less by mass has high heat resistance and flame resistance.

(Casting)

A cast material (cast sheet) can be suitably used as the raw material sheet. The cast sheet is produced by a continuous casting process such as an ingot casting process or a twin-roll casting process. In particular, since a twin-roll casting process allows rapid solidification, internal defects caused by segregation, oxides, or the like can be reduced, and cracking generated from the internal defects during plastic forming such as rolling can be suppressed. That is, a twin-roll casting process is preferred because a cast sheet having good rolling property is produced. In particular, in a magnesium alloy containing a large amount of Al, generation of impurities in crystal and precipitated impurities and segregation are easily caused during casting. Such impurities in crystal and precipitated impurities and segregates readily remain inside the alloy even if a rolling step or the like is performed after the casting. However, since segregation or the like can be reduced as described above, the twin-roll cast sheet can be suitably used as the raw material sheet. The thickness of the cast sheet is not particularly limited, but is preferably 10 mm or less, more preferably 5 mm or less, and particularly preferably 4 mm or less because segregation is easily caused in an excessively thick cast sheet. The width of the cast sheet is also not particularly limited. A cast sheet having a width that allows the cast sheet to be produced in production equipment can be used. The long cast sheet is coiled to produce a cast coil stock, which is used in the next step. Upon coiling, when the temperature of a start-of-coiling portion in the cast material is about 100 to 200° C., even alloys such as AZ91 alloy in which cracking is easily caused are easily bent and coiled.

(Solution Treatment)

Rolling may be performed on the cast sheet, but a solution treatment may be performed before rolling. The cast sheet can be homogenized through the solution treatment. The solution treatment is performed at a holding temperature of 350° C. or more and preferably 380 to 420° C. for a holding time of 30 to 2400 minutes. The holding time is preferably increased as the content of Al increases. In a cooling step after the holding time, the precipitation of a coarse precipitate can be suppressed by increasing the cooling rate using accelerated cooling such as water cooling or air blast cooling. Consequently, a sheet having good rolling property can be produced. In the case where the solution treatment is performed on a long cast sheet, the cast sheet can be efficiently heated in a state in which the cast sheet is coiled like the cast coil stock above.

(Preheating)

A magnesium alloy sheet (thin sheet) having a desired thickness is produced by rolling the raw material sheet or cast sheet that has been subjected to the solution treatment. Before rolling, the raw material is preheated to increase the plastic formability (rolling property) of the raw material sheet. In the preheating, by using heating means such as a heat box 2 shown in FIG. 1(B), a long raw material sheet can be heated at a time and thus good workability is achieved. The heat box 2 is a hermetically-sealed container that can contain a coiled raw material sheet 1 and is an atmosphere furnace in which hot air with a predetermined temperature is supplied in a circulated manner by a heating mechanism (not shown) and a desired temperature can be kept. In particular, when the raw material sheet 1 can be directly drawn out from the heat box 2 and rolled, a time until the heated raw material sheet 1 is brought into contact with reduction rolls 3 can be shortened and thus a decrease in the temperature of the raw material sheet 1 before the heated raw material sheet 1 is brought into contact with the reduction rolls 3 can be effectively suppressed. Specifically, the heat box 2 can contain a raw material sheet 1 in a coiled state and rotatably supports a reel 10 that can feed and coil the raw material sheet 1. The raw material sheet 1 is contained in the heat box 2, the raw material sheet 1 is heated to a certain temperature, and then the raw material sheet 1 is drawn out by rotating the reel 10. FIG. 1(B) shows the state in which a raw material sheet 1 in a coiled state is contained in the heat box 2. Practically, the heat box 2 is used in a closed state, but the front is opened in FIG. 1(B) for ease of understanding.

In a preheating step, the raw material sheet is heated so that the temperature of the raw material sheet is 280° C. or less. That is, in the preheating step, the raw material sheet is heated so that the maximum temperature of the raw material sheet does not exceed 280° C. The setting temperature of the heating means such as a heat box can be selected in a range of 280° C. or less. In particular, the setting temperature is preferably adjusted so that the temperature of the raw material sheet just before rolling is in a range of 150 to 280° C. throughout all passes. When rolling is performed on the raw material sheet with multiple passes, the temperature of the raw material sheet tends to increase due to heat by working as described above. On the other hand, the temperature of the raw material sheet may decrease before the raw material sheet is uncoiled and brought into contact with the reduction rolls. Therefore, the setting temperature of the heating means is preferably adjusted in consideration of the rolling speed (mainly the traveling speed of a raw material during rolling), the distance between the heat box and the reduction rolls, the temperature of the reduction rolls, the number of passes, the thickness of the raw material sheet (heat capacity), and the like. The setting temperature of the heating means is preferably 150 to 280° C. as described above, more preferably 210° C. or more, and particularly preferably 250 to 280° C. The heating time may be a time required to heat the raw material sheet to a certain temperature. However, in the raw material sheet in a coiled state, a variation in temperature between the inside region and outside region of the coil is easily caused. Thus, a sufficiently long time is preferably ensured so that the entire raw material sheet has a uniform temperature. For example, the first preheating time can be set to be relatively long and the preheating time (preheating time between passes) of a raw material sheet (in a heated state because of preheating, contact with reduction rolls, or heat by working) heated to some degree by being subjected to at least one pass of rolling can be set to be relatively short in accordance with the temperature of the raw material sheet. By shortening the preheating time between passes, the productivity of a rolled sheet can be improved. In addition, the heating time may be suitably set in accordance with the weight and size (width, thickness) of a coil, the number of turns of a coil, and the like.

(Rolling)

The raw material sheet 1 heated with the heating means such as the heat box 2 is taken out of the heat box 2 and supplied to the reduction rolls 3 to perform rolling. Specifically, a rolling line shown in FIG. 1(A) may be build. The rolling line includes a pair of reels 10*a* and 10*b* that are disposed separately and can be reversibly operated and a pair of reduction rolls 3 facing each other and disposed between the pair of reels 10*a* and 10*b* so as to sandwich a traveling raw material sheet 1. A coiled raw material sheet 1 is installed in the reel 10*a* and uncoiled and one end of the raw material sheet 1 is coiled with the reel 10*b*, whereby the raw material sheet 1 travels between the reels 10*a* and 10*b*. During the traveling, the raw material sheet 1 can be rolled by being sandwiched between the reduction rolls 3. In an example shown in FIG. 1(A), the reels 10*a* and 10*b* are contained in heat boxes 2*a* and 2*b*, respectively, and the raw material sheet 1 coiled with the reels 10*a* and 10*b* can be heated with the heat boxes 2*a* and 2*b*, respectively. The heated raw material sheet 1 is uncoiled with one of the reels, is discharged from one of the heat boxes, travels toward the other of the heat boxes, and is coiled with the other of the reels.

Herein, both ends of the raw material sheet 1 are coiled with the reels 10*a* and 10*b*, and an intermediate region other than both end regions coiled with the reels 10*a* and 10*b* is introduced into the reduction rolls 3 to perform rolling with multiple passes. The rolling is performed by reversing the rotating directions of the reels 10*a* and 10*b* every one pass. That is, reverse rolling is performed. Therefore, the raw material sheet 1 is not removed from the reels 10*a* and 10*b* until a final pass.

In FIG. 1, the number of the reduction rolls 3 is merely an example, and multiple pairs of reduction rolls may be disposed in a direction in which the raw material sheet 1 travels.

In the production method of the present invention, the reduction rolls are also heated to a certain temperature, specifically a temperature of 230 to 290° C. Since the raw material sheet can be kept in a sufficiently heated state by heating the reduction rolls to 230° C. or more, a state in which the raw material sheet has good plastic formability can be achieved, resulting in proper rolling. By setting the temperature to be 290° C. or less, the increase in the size of crystal grains of the raw material sheet and the release of working strain introduced by rolling are suppressed and a rolled sheet having good press formability can be produced. By specifying the setting temperature of the reduction rolls in a narrow range of 60° C., excessive heating of the reduction rolls can be suppressed, and a variation in the thickness of a rolled sheet and the generation of telescoping caused by the variation in thickness can be effectively reduced. In particular, when the temperature of the raw material sheet just before the raw material sheet is supplied to the reduction rolls is suitably measured with a temperature sensor 4 to perform temperature controlling such as a change in the temperature of the reduction rolls on the basis of the measured temperature, the setting temperature above is easily maintained with certainty. The temperature of the reduction rolls may also be measured with another temperature sensor 4. By controlling the temperature of the reduction rolls so that a variation in temperature in the width direction of the reduction rolls is ±5° C. of the above-described setting temperature, that is, the variation in temperature is within 10° C., the variation in thickness and telescoping can be effectively reduced. For example, multiple temperature sensors may be disposed in the width direction of the reduction rolls so that the temperatures in multiple points in the width direction of the reduction rolls can be measured. The temperature of the reduction rolls may be adjusted in accordance with the measured temperatures. Furthermore, when the temperatures of the reduction rolls and raw material sheet are controlled so that the difference in temperature between the raw material sheet and the reduction rolls is small (e.g., 30° C. or less and preferably 10° C. or less), a longer rolled sheet can be produced.

When the raw material sheet 1 is taken out of the heat box 2, the surface temperature of the raw material sheet 1 slightly decreases before contacting the reduction rolls 3 as described above. Herein, in the case where the heating means such as the heat box 2 does not include the reels 10*a* and 10*b*, the raw material sheet 1 heated in the heating means needs to be taken out of the heating means and installed in a supplying machine. To reduce a decrease in temperature until the installment as much as possible, the way of conveyance can be improved (e.g., covering with a heat insulator) or the time for the installment can be shortened. As a result, a decrease in the temperature of the raw material sheet caused by conveyance and installment operations can be suppressed. It is believed that, since the entire raw material sheet 1 in a coiled state has a higher heat capacity than a portion of the uncoiled raw material sheet 1, the temperature is not easily decreased during the conveyance and installment. In contrast, after the raw material sheet 1 is fed from the reel 10 or the supplying machine, a decrease in temperature until the raw material sheet 1 contacts the reduction rolls 3 may become relatively significant. This may be because a portion of the uncoiled raw material sheet has a low heat capacity as described above and magnesium alloys are metals having good heat conductivity, whereby the raw material sheet is easily cooled. The degree of a decrease in the temperature of the raw material sheet 1 until the raw material sheet 1 contacts the reduction rolls 3 is affected by, for example, the thickness and traveling speed of the raw material sheet 1. As the thickness of the raw material sheet 1 decreases or as the rolling speed decreases, the temperature tends to decrease. For example, though also depending on other conditions, when a raw material sheet heated to about 250° C. and having a thickness of 1.0 mm is supplied to reduction rolls with a traveling speed of 5 m/min, the temperature of the raw material sheet just before entering the reduction rolls is about 170° C. When such a sheet is supplied with a traveling speed of 15 m/min, the temperature is about 190° C. The inventors of the present invention have also confirmed that, when the temperature of the raw material sheet is 170° C. and the temperature of the reduction rolls is 240° C. (thickness: 1.0 mm, 5 m/min), continuous rolling can be performed in a length of 300 m or more. Therefore, the raw material sheet 1 is supplied to the reduction rolls 3 at a surface temperature of 150° C. or more, preferably 170° C. or more, more preferably 180° C. or more, and particularly preferably 210° C. or more, though depending on the thickness of the raw material sheet or the like. The rotational speed (peripheral speed) of the reduction rolls may be suitably adjusted in accordance with the traveling speed of the raw material sheet. For example, when the rotational speed is 5 to 90 m/min, rolling can be efficiently performed.

The heating of the reduction rolls 3 may be achieved by integrating a heater such as a cartridge heater (heater type), circulating a liquid such as heated oil (liquid circulation type), blowing gas such as hot air (hot air type), or applying a heated lubricant. In particular, when the reduction rolls 3 are heated by circulating heated oil inside the reduction rolls 3, the reduction rolls can be filled with the heated liquid uniformly in the width and circumferential directions. Therefore, a variation in temperature (difference between maximum temperature and minimum temperature) in the width direction of the reduction rolls is easily suppressed. For example, the variation in temperature above can be suppressed to 10° C. or less, furthermore 5° C. or less, and particularly 3° C. or less. The temperature of the liquid circulated is preferably about a temperature of setting surface temperature of reduction rolls+10° C., though depending on the size (width, diameter) and material of the reduction rolls. To circulate the liquid above, for example, a liquid circulation system used for water-cooled copper or the like can be employed. In the heater type, preferably, a plurality of heaters are integrated, temperatures in multiple points in the width direction of the reduction rolls are measured, and the ON/OFF and output of each of the heaters are controlled in accordance with the measured temperatures in order to reduce a variation in temperature in the width direction of the reduction rolls 3. In the hot air type, the temperature of gas, the amount of gas blown, the number of nozzles, the positions of nozzles disposed, and the like are controlled.

In all passes of the rolling, the reduction ratio per pass can be suitably selected. The reduction ratio per pass is preferably 10% or more and 40% or less and the total reduction ratio is preferably 75% or more and 85% or less. By performing rolling on the raw material sheet multiple times (with multiple passes) at such a reduction ratio, a desired sheet thickness can be achieved, the average crystal grain size can be decreased, and the press formability can be improved. In addition, the occurrence of defects such as surface cracks can be suppressed.

In the rolling, a lubricant is preferably used because the friction between the reduction rolls and the raw material sheet is reduced and thus proper rolling is performed. The lubricant may be suitably applied to the reduction rolls. Herein, the inventors have found that some types of lubricants are left on the raw material sheet and altered in quality. They have also found that, although the detailed mechanism is unclear, the lubricant is easily left on both edge portions compared with the central portion in the width direction of the raw material sheet, and the locally left lubricant tends to cause telescoping. Finally, they have found that a lubricant that is not easily altered at 290° C., which is the maximum heating temperature of the reduction rolls, or at about 300° C. in consideration of allowance is preferably used to suppress such telescoping. Therefore, a proper lubricant is preferably selected in accordance with the setting temperature of the reduction rolls. To prevent a lubricant from being locally left, a lubricant on the surface of the raw material sheet is preferably smoothed just before the raw material sheet is supplied to the reduction rolls. For example, smoothing means such as a brush or a wiper is disposed on the upstream side of the reduction rolls, and an uneven lubricant on the surface of the raw material sheet is made uniform.

Pinch rolls (not shown) can be disposed before and after the reduction rolls to adjust the tension applied to the raw material sheet 1 during rolling. The pinch rolls are preferably heated to about 200 to 250° C. to prevent a decrease in the temperature of the raw material sheet caused by contact with the pinch rolls.

To prevent a decrease in the temperature of the raw material sheet 1 fed from the reel 10 or the supplying machine until the raw material sheet 1 contacts the reduction rolls 3, a heat-insulating cover 5 composed of a heat-insulating material can be disposed in a region from the reel 10 to the reduction rolls 3 so as to cover the raw material sheet 1, or auxiliary heating means (not shown) such as a heating lamp for heating the raw material sheet 1 can be disposed.

(Coiling)

A rolled sheet obtained by performing the above-described rolling is coiled. After an intended number (of passes) of rolling is performed by repeatedly conducting the preheating step, the rolling step, and the coiling step above in a continuous manner, the obtained rolled sheet (magnesium alloy sheet) is finally coiled. The obtained magnesium alloy sheet constituting the coil stock of the present invention has a microstructure including working strain (shear zone) introduced by rolling. The magnesium alloy sheet with such a microstructure has good plastic formability because dynamic recrystallization is caused during plastic forming such as press forming. In particular, when the rolled sheet is coiled after the temperature of the rolled sheet just before coiling is set to be a temperature that does not cause recrystallization, specifically 250° C. or less, in the rolling of a final pass, a magnesium alloy sheet having good flatness and a microstructure including the working strain sufficiently left therein can be obtained. To set the temperature of the rolled sheet just before coiling to be a temperature that does not cause recrystallization, the traveling speed of the raw material sheet may be adjusted. However, by cooling the rolled sheet with accelerated cooling such as air blast cooling, a desired temperature can be provided within a short time, which results in good workability.

(Leveling Step)

The coil stock of the present invention obtained by coiling can be directly used as a product (typically, a raw material of magnesium alloy structural members such as members subjected to plastic forming). Furthermore, the coil stock may be uncoiled and certain bending may be imparted to the rolled sheet to control (level) the amount of working strain introduced by rolling. A roller leveler can be suitably used for the leveling. The roller leveler includes at least a pair of rollers disposed so as to face each other and imparts bending to a raw material by passing the raw material between the rollers. In particular, a roller leveler that includes a plurality of rollers disposed in a staggered manner and can repeatedly impart bending to a rolled sheet by passing the rolled sheet between the rollers can be suitably used. As a result of such leveling, a magnesium alloy sheet having better flatness is obtained and furthermore good plastic formability such as good press formability is achieved because the working strain is sufficiently present. When heating means such as a heater is provided to the rollers above and warm leveling in which bending is imparted to a rolled sheet using heated rollers is performed, cracking or the like is not easily caused. The temperature of the rollers is preferably 100° C. or more and 300° C. or less. The amount of bending imparted by leveling can be controlled by adjusting, for example, the size and number of rollers, the gap between rollers facing each other, and the distance between rollers adjacent to each other in the direction in which the raw material travels. The magnesium alloy sheet (rolled sheet) serving as a raw material may be heated in advance before leveling. Specifically, the heating temperature is 100° C. or more and 250° C. or less and preferably 200° C. or more. By also heating the raw material, leveling can be properly performed without causing cracking or the like.

The magnesium alloy sheet subjected to the leveling step can be directly used as a product (typically, a raw material of magnesium alloy structural members such as members subjected to plastic forming). To further improve the surface state, surface polishing may be performed using a polishing belt.

[Coil Stock]

The coil stock of the present invention produced by the production method of the present invention has small telescoping as described above and there is no need of recoiling when products are shipped. The coil stock of the present invention also has small edge cracking. Therefore, a step of removing edge-cracked portions is not required or the amount of edge-cracked portions removed can be reduced. In this regard, the productivity can be improved.

A typical form of the magnesium alloy sheet constituting the coil stock of the present invention is a rolled sheet as described above. In addition, a leveled sheet obtained by subjecting the rolled sheet to leveling and a polished sheet obtained by subjecting the rolled sheet to polishing are exemplified. The thickness, width, and length of the magnesium alloy sheet can each be given any value in accordance with the specifications of a cast sheet used as a raw material and the rolling conditions. In the case where the coil stock of the present invention is used as a raw material of members subjected to plastic forming such as members subjected to press forming, the thickness is preferably 3.0 mm or less, more preferably 1.5 mm or less, further preferably 0.1 mm or more and 1 mm or less, and particularly preferably about 0.6 mm or more and 0.8 mm or less because a lightweight thin member subjected to plastic forming is obtained. The width is preferably 50 mm or more, more preferably 100 mm or more, and particularly preferably 200 mm or more. The length is preferably 50 m or more, more preferably 100 m or more, and particularly preferably 200 m or more because the amount of raw material that can be supplied, at a time, to a plastic forming machine such as a pressing machine is large, which can contribute to the improvement in the productivity of members subjected to plastic forming.

The magnesium alloy sheet constituting the coil stock of the present invention has small edge cracking as described above and also has a small variation in thickness in the width direction. The magnesium alloy sheet also has good flatness. Since the magnesium alloy sheet is uniformly rolled, the magnesium alloy sheet has a uniform metal microstructure in the width direction and also has a uniform microstructure and flatness in the longitudinal direction (e.g., over 10 m or more or furthermore 100 m or more).

Example 1

The rolling line (including a pair of heat boxes each including a reel and a pair of reduction rolls disposed so as to face each other) shown in FIG. 1(A) was built. A raw material to be rolled below was repeatedly subjected to preheating, rolling, and coiling in a continuous manner multiple times to produce a long rolled sheet. The rolling was performed under the conditions below. The preheating temperatures of raw material sheets (a cast sheet constituting a cast coil stock and a rolled sheet being subjected to rolling) and the heating temperatures (setting temperatures) of reduction rolls are shown in Tables I and II. Under two conditions (3° C. and 20° C.) under which temperature distributions in the width direction of the reduction rolls are different, a plurality of samples were prepared.

(Raw Material to be Rolled)

AZ91 alloy, twin-roll cast coil stock

Sheet thickness: 4.1 mm, Sheet width: 265 mm, Length: 50 m

Solution treatment: 400° C.×20 hours (Rolling Conditions)

Rolling with multiple passes, reduction ratio: 20 to 25% per pass

Thickness in the end: rolled to 0.8 mm (length: 150 m), Total reduction ratio: 80%

Preheating of raw material sheet (inside the heat boxes, heating time (cast coil stock): 3 hours)

Heating method of reduction roll: heating from the inside of roll

In the reduction roll whose temperature distribution in the width direction (variation in the surface temperature of the roll) was 3° C., heated oil was circulated inside the roll. In the reduction roll whose temperature distribution in the width direction was 20° C., a plurality of heaters were integrated in the roll (the setting temperatures of the heaters are the same). The variation in temperature was determined by measuring the surface temperature of the reduction rolls in the manner described below while the temperature of the rolls was stabilized before the raw material sheet was passed through the reduction rolls. An arbitrary straight line is assumed in the width direction (the direction parallel to the axial direction) of a reduction roll in a region where a raw material sheet contacts the surface of the reduction roll, and temperatures in multiple points on this straight line are measured. The difference between the maximum temperature and the minimum temperature among these temperatures in the multiple points is defined as a variation in temperature. Herein, the arbitrary straight line was assumed on the surface of the reduction roll, ten points were taken on the straight line at regular intervals, and the temperatures in the ten points were measured. The difference between the maximum temperature and the minimum temperature among the temperatures in the ten points was defined as the variation in temperature.

(Evaluation Items and Determination Criteria of Rolled Material)

The variation in thickness (distribution of sheet thickness), flatness, surface state, and press formability of a magnesium alloy sheet obtained by rolling were evaluated. Tables I and II show the results. The evaluations were conducted using sample sheets prepared by uncoiling a coil stock coiled after rolling and cutting the uncoiled sheet into a length of 300 mm.

Distribution of sheet thickness: Ten points were freely selected in the width direction of the sample sheet, and the thickness in each of the points was measured with a micrometer. The difference between the maximum thickness and the minimum thickness among the thicknesses in the ten points was determined. When the difference was within 30 μM, "Good" was given. When the difference was more than 30 μm, "Poor" was given.

Flatness: The sample sheet was placed on a surface plate and the gap between the sample sheet and the surface plate was measured with a clearance gage. When the maximum value of the gap was 2 mm or less, "Good" was given. When the maximum value of the gap was more than 2 mm, "Poor" was given. When it was confirmed through visual inspection that the sample sheet was curved inward in the central portion in the width direction, the maximum depth from a straight line connecting both edges of the sample sheet in the width direction to the inwardly depressed portion was measured. When the maximum depth was 1 mm or more, such a state was evaluated as "Center buckle" and "Center buckle" is noted in Tables I and II.

Surface state: When no cracks were found over the entire sample sheet through visual inspection, "Good" was given. When cracks were found, "Poor" was given. If seizing was found, "Seizing" is noted in Table I.

Press formability: The sample sheet was subjected to press forming (cylindrical deep drawing, diameter: 30 mm, corner R: 2 mm). When no cracks were found after the press forming, "Good" was given. When cracks or the like were found in the corner angle R portion, "Poor" was given. When no evaluation was performed, "-" was given. Herein, after the sample sheet was preheated to 250° C., the press forming above was performed.

TABLE I

Variation in temperature on the surface of a roll: 3° C.

| | Heating | Surface | Evaluation item | | | | |
|---|---|---|---|---|---|---|---|
| Sample No. | temperature of raw material sheet | temperature of reduction roll | Flatness | Distribution of sheet thickness | Surface state | Press formability | Determination |
| 1 | 275° C. | 230° C. | Good | Good | Good | Good | Good |
| 2 | 260° C. | 240° C. | Good | Good | Good | Good | Good |
| 3 | 250° C. | 280° C. | Good | Good | Good | Good | Good |
| 101 | 250° C. | 200° C. | Good | Good | Poor Cracking | Poor | Poor |
| 102 | 300° C. | 200° C. | Poor Center buckle | Poor | Good | — | Poor |
| 103 | 300° C. | 230° C. | Good | Good | Good | Poor | Poor |
| 104 | 250° C. | 300° C. | Good | Good | Poor Seizing | Poor | Poor |

TABLE II

Variation in temperature on the surface of a roll: 20° C.

| | Heating | Surface | Evaluation item | | | | |
|---|---|---|---|---|---|---|---|
| Sample No. | temperature of raw material sheet | temperature of reduction roll | Flatness | Distribution of sheet thickness | Surface state | Press formability | Determination |
| 105 | 275° C. | 230° C. | Poor Center buckle | Poor | Good | — | Poor |
| 106 | 260° C. | 240° C. | Poor Center buckle | Poor | Good | — | Poor |

TABLE II-continued

| Variation in temperature on the surface of a roll: 20° C. | | | | | | | |
|---|---|---|---|---|---|---|---|
| | Heating | Surface | Evaluation item | | | | |
| Sample No. | temperature of raw material sheet | temperature of reduction roll | Flatness | Distribution of sheet thickness | Surface state | Press formability | Determination |
| 107 | 250° C. | 290° C. | Poor Center buckle | Poor | Good | — | Poor |

As shown in Tables I and II, in the sample Nos. 1 to 3 prepared by repeatedly performing preheating, rolling, and coiling in a continuous manner multiple times under the conditions that the heating temperature of the raw material sheet was 280° C. or less and the temperature of the reduction rolls was 230 to 290° C., "Good" was given in all the evaluation items. The overall determination was "Good". On the other hand, in the sample Nos. 101 to 104 prepared without performing preheating or rolling under the specific conditions above, "Poor" was given in at least one of the evaluation items and the overall determination was "Poor". As is clear from these results, the preheating temperature of the raw material sheet and the heating temperature of the reduction rolls affect the characteristics of a magnesium alloy sheet that has been subjected to rolling. In particular, it is clear that, when continuous rolling is performed, the temperatures of the raw material sheet and reduction rolls are preferably set in the above-described specific range. It is also clear that a magnesium alloy sheet produced under such specific rolling conditions has good press formability. Furthermore, it is clear that such a magnesium alloy sheet having good press formability can be continuously produced by employing the above-described specific rolling conditions.

In addition, a large variation in the temperature of the reduction rolls causes local deformation of the reduction rolls due to thermal expansion. As a result, it is clear that the variation in the thickness of the produced rolled sheet (magnesium alloy sheet) is increased, the flatness becomes worse, and cracking or the like is easily caused. Therefore, it is clear that rolling can be more properly performed by setting the temperatures of the raw material sheet and reduction rolls in the specific range and performing temperature controlling so that the variation in the temperature in the width direction of the reduction rolls is decreased.

In the preparation of the sample Nos. 1 to 3, the temperature of the raw material sheet was controlled so that the temperature of the raw material sheet just before rolling was 150 to 280° C. in all passes including a final pass of the rolling. In addition, the temperatures of the raw material sheet and reduction rolls, the traveling speed of the raw material sheet, and the like were controlled so that the difference between the temperature of the raw material sheet just before rolling and the surface temperature of the reduction rolls was 30° C. or less. Consequently, a long rolled sheet having good press formability was more stably produced.

Example 2

As in Example 1, the rolling line shown in FIG. 1(A) was built. A raw material to be rolled below was repeatedly subjected to preheating, rolling, and coiling in a continuous manner multiple times to produce a long rolled sheet. The raw material to be rolled and the rolling conditions are described below. The production conditions of sample Nos. 4 and 108 are the same as each other, except for use of a lubricant.

(Raw Material to be Rolled)

AZ91 alloy, twin-roll cast coil stock

Sheet thickness: 4.0 mm, Sheet width: 265 mm, Length: 200 m

Solution treatment: 400° C.×20 hours (Rolling Conditions)

Rolling with eight passes, reduction ratio: 20 to 25% per pass

Thickness in the end: rolled to 0.6 mm (length: 900 m), Total reduction ratio: 85%

Preheating of raw material sheet (inside the heat boxes, 250° C., heating time (cast coil stock): 5 hours)

Heating method of reduction roll: circulation of heated oil inside the roll (surface temperature: 270° C.)

Use of lubricant (commercially available product, sample No. 4: a lubricant that is not altered at 300° C., sample No. 108: a lubricant that is altered at 250° C.)

In the prepared sample Nos. 4 and 108, telescoping and edge cracking were measured as follows. Regarding the telescoping, among edges on one side of turns that constitute the coil stock of each of the samples obtained by coiling a rolled sheet, the distance between an edge that protrudes most and an edge that depresses most in the axial direction of the coil stock was measured. This distance was defined as a value of telescoping. Regarding the edge cracking, the coil stock of each of the samples was uncoiled and cut into a length of 300 mm to prepare a sample sheet. The length of each crack present in the edge portion of the sample sheet was measured in the width direction of the sample sheet. The length was defined as the length of edge cracking. Furthermore, press forming was performed on the prepared sample sheets under the same conditions as those of Example 1 to evaluate press formability.

As a result, the sample No. 4 prepared by repeatedly performing preheating, rolling, and coiling in a continuous manner multiple times under the conditions that the heating temperature of the raw material sheet was 280° C. or less and the temperature of the reduction rolls was 230 to 290° C. had good press formability as in the sample Nos. 1 to 3 of Example 1. In the sample No. 4 that uses a certain lubricant, the telescoping was as small as 5 mm or less and the length of edge cracking was as small as 5 to 7 mm. In contrast, in the sample No. 108, the telescoping was as large as 10 to 20 mm and the length of edge cracking was as large as 10 to 20 mm.

Also in the sample Nos. 1 to 3 of Example 1, when rolling was performed using the same lubricant as that of the sample No. 4, the telescoping was 5 mm or less and the length of edge cracking was 8 mm or less.

As is clear from the above description, by using a suitable lubricant, a magnesium alloy coil stock having good press formability, appearance, and surface texture is produced.

It is to be understood that the scope of the present invention is not limited to the examples above, and is defined in the appended claims and includes equivalence of the description of the claims and all changes within the scope of the claims. For example, the composition of a magnesium alloy and the thickness, width, and length of a raw material sheet can be suitably changed. The production method of the present invention can be suitably used for the production of a long sheet in a coiled state, the production of a long sheet without coiling, and the production of a short sheet obtained by uncoiling a coiled long sheet and cutting the long sheet into a desired length.

INDUSTRIAL APPLICABILITY

The method for producing a magnesium alloy sheet of the present invention can be suitably used for the production of a rolled coil stock obtained by coiling a long rolled sheet. The magnesium alloy coil stock of the present invention can be suitably used for various constitutional members of electric and electronic devices, in particular, housings of mobile or small electric and electronic devices and members in various fields that need to have high strength, such as constitutional members of transport machines, e.g., automobiles and airplanes.

REFERENCE SIGNS LIST

1 raw material sheet
2, 2*a*, 2*b* heat box
3 reduction roll
4 temperature sensor
5 protective cover
10, 10*a*, 10*b* reel

The invention claimed is:

1. A method for producing a magnesium alloy sheet in which a raw material sheet composed of a magnesium alloy is rolled and the obtained long rolled sheet is coiled to produce a coiled magnesium alloy sheet, the method comprising:

a preheating step of heating the raw material sheet;

a rolling step of rolling the heated raw material sheet with a reduction roll;

a heat-insulating step of conveying the heated raw material sheet through a heat-insulating cover disposed between the preheating step and the rolling step;

measuring a temperature of the reduction roll, wherein the temperature of the reduction roll is controlled by comparing the temperature of the reduction roll and the temperature of the heated raw material sheet; and a coiling step of coiling the rolled sheet, wherein the heating temperature of the raw material sheet in the preheating step is 280° C. or less, the surface temperature of the reduction roll in the rolling step is 230° C. or more and 290° C. or less, the preheating step, the rolling step, and the coiling step are repeatedly performed in a continuous manner multiple times, wherein a lubricant is used in the rolling step and the lubricant on the surface of the raw material sheet is smoothed just before the raw material sheet is supplied to the reduction roll, and a temperature of the heated raw material sheet is measured after the preheating step and before the rolling step.

2. The method for producing a magnesium alloy sheet according to claim 1, wherein the magnesium alloy contains aluminum in an amount of 7.0% or more by mass and 12.0% or less by mass.

3. The method for producing a magnesium alloy sheet according to claim 1, wherein, in all passes including a final pass of the rolling, the temperature of the raw material sheet just before rolling is 150° C. or more and 280° C. or less.

4. The method for producing a magnesium alloy sheet according claim 1, wherein a difference between the temperature of the raw material sheet just before rolling and the surface temperature of the reduction roll is 30° C. or less.

5. The method for producing a magnesium alloy sheet according to claim 1, wherein the raw material sheet is a cast sheet produced by subjecting a molten magnesium alloy to continuous casting by a twin-roll casting process.

6. The method for producing a magnesium alloy sheet according to claim 1, wherein the lubricant is applied to the reduction roll.

7. The method for producing a magnesium alloy sheet according to claim 1, wherein a variation in the surface temperature, which is a difference between the maximum temperature and the minimum temperature, of the reduction roll in a width direction of the reduction roll is 3° C. or less.

* * * * *